US011040427B2

(12) United States Patent
Takenouchi

(10) Patent No.: US 11,040,427 B2
(45) Date of Patent: Jun. 22, 2021

(54) WORKPIECE PROCESSING METHOD

(71) Applicant: DISCO CORPORATION, Tokyo (JP)

(72) Inventor: Kenji Takenouchi, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 14/644,863

(22) Filed: Mar. 11, 2015

(65) Prior Publication Data

US 2015/0261211 A1 Sep. 17, 2015

(30) Foreign Application Priority Data

Mar. 12, 2014 (JP) ..... JP2014-049050

(51) Int. Cl.
*B24B 37/04* (2012.01)
*B24B 7/22* (2006.01)
*B24B 57/02* (2006.01)

(52) U.S. Cl.
CPC ..... *B24B 7/228* (2013.01); *B24B 7/22* (2013.01); *B24B 37/04* (2013.01); *B24B 37/044* (2013.01); *B24B 57/02* (2013.01)

(58) Field of Classification Search
CPC ..... B24B 7/228; B24B 37/044; B24B 57/02
USPC ..... 451/36, 41
See application file for complete search history.

(56) References Cited

U.S. PATENT DOCUMENTS

2003/0189186 A1 10/2003 Chen et al.
2004/0070064 A1* 4/2004 Yamane ..... H01L 24/24 257/686
2004/0127146 A1* 7/2004 Oshima ..... C09K 3/1463 451/36
2005/0032463 A1* 2/2005 Kitayama ..... C09G 1/02 451/41
2005/0054273 A1* 3/2005 Osawa ..... B24B 37/00 451/41
2005/0170640 A1* 8/2005 Nakagawa ..... H01L 21/31058 438/631
2010/0197201 A1* 8/2010 Nomura ..... C09G 1/02 451/36
2012/0024818 A1* 2/2012 Ono ..... B24B 37/044 216/53
2012/0077422 A1* 3/2012 Yoshino ..... B24B 37/044 451/59
2013/0020283 A1* 1/2013 Ono ..... B24B 37/044 216/53
2014/0349484 A1* 11/2014 Yokota ..... H01L 21/3212 438/693

FOREIGN PATENT DOCUMENTS

JP 2001-085372 3/2001
JP 2004-071673 3/2004
JP 2006-086353 3/2006
JP 2010-129941 6/2010
JP 2011-181827 9/2011
(Continued)

*Primary Examiner* — Eileen P Morgan
(74) *Attorney, Agent, or Firm* — Greer Burns & Crain, Ltd.

(57) ABSTRACT

A method of processing a workpiece which includes metal in a work surface by a processing unit including a grindstone or a polishing pad includes a processing step of grinding or polishing the workpiece by the processing unit while supplying a processing fluid to the work surface of the workpiece. The processing fluid contains an organic acid and an oxidizing agent.

17 Claims, 2 Drawing Sheets

(56) References Cited

FOREIGN PATENT DOCUMENTS

| | | |
|---|---|---|
| JP | 2013-008898 | 1/2013 |
| JP | 2013-138053 | 7/2013 |
| WO | 2011/007588 | 1/2011 |
| WO | 2012/008237 | 1/2012 |
| WO | 2012/165016 | 12/2012 |
| WO | 2013/115172 | 8/2013 |

* cited by examiner

WORKPIECE PROCESSING METHOD

BACKGROUND OF THE INVENTION

Field of the Invention

The present invention relates to a method of processing a workpiece which includes metal.

Description of the Related Art

In recent years, attention has been paid to WL-CSP (Wafer Level Chip Size Package) in which operations up to packaging of a product are conducted while the product is in a wafer state. In the WL-CSP, a rewiring layer (a redistribution layer) and metal posts (electrodes) are provided on the front surface side of devices formed on a wafer, and, after sealing the wafer with resin or the like, the sealed wafer (WL-CSP substrate) is divided by such a method as cutting. The WL-CSP, in which the size of the divided chip coincides directly with the size of the package, is advantageous from the viewpoint of downsizing.

Meanwhile, a ductile material such as metal is plastically elongated when a stress is exerted thereon and, therefore, cannot easily be processed by such a method as grinding or polishing. Accordingly, in the case of thinning the sealing layer side of a workpiece that includes metal such as, for example, a WL-CSP substrate, it may be necessary to grind or shave off the sealing layer and the like by a method such as grinding and thereafter to process the metal by another method such as cutting with a cutting tool (see, for example, Japanese Patent Laid-Open No. 2013-8898).

SUMMARY OF THE INVENTION

However, a combination of a plurality of different methods as aforementioned leads to an intricate production process and a higher production cost.

Accordingly, it is an object of the present invention to provide a processing method by which a workpiece that includes metal can be suitably processed through a simple process.

In accordance with an aspect of the present invention, there is provided a method of processing a workpiece that includes metal at least in a work surface thereof by processing means including a grindstone or a polishing pad, the method including: a processing step of grinding or polishing the workpiece by the processing means while supplying a processing fluid to the work surface of the workpiece, wherein the processing fluid contains an organic acid and an oxidizing agent.

In the present invention, it is preferable that the processing fluid further contains an anticorrosive.

In the processing method according to the present invention, the processing fluid containing an organic acid and an oxidizing agent is supplied, whereby the workpiece can be ground or polished while suppressing the ductility of the metal included in the work surface through modification of the metal. Therefore, a workpiece that includes metal can be suitably processed through a simple process.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

An embodiment of the present invention will be described below, referring to the attached drawings. It is to be noted that while in this embodiment a description will be made of a processing method of grinding a plate-shaped workpiece by a grinding mechanism (processing means) that includes a grindstone for grinding (grindstone), the processing method according to the present invention is not limited to this described method. For instance, the processing method of the present invention is applicable also to cases where a plate-shaped workpiece is polished by a polishing mechanism (processing means) that includes a pad for polishing (polishing pad).

Figure 1:
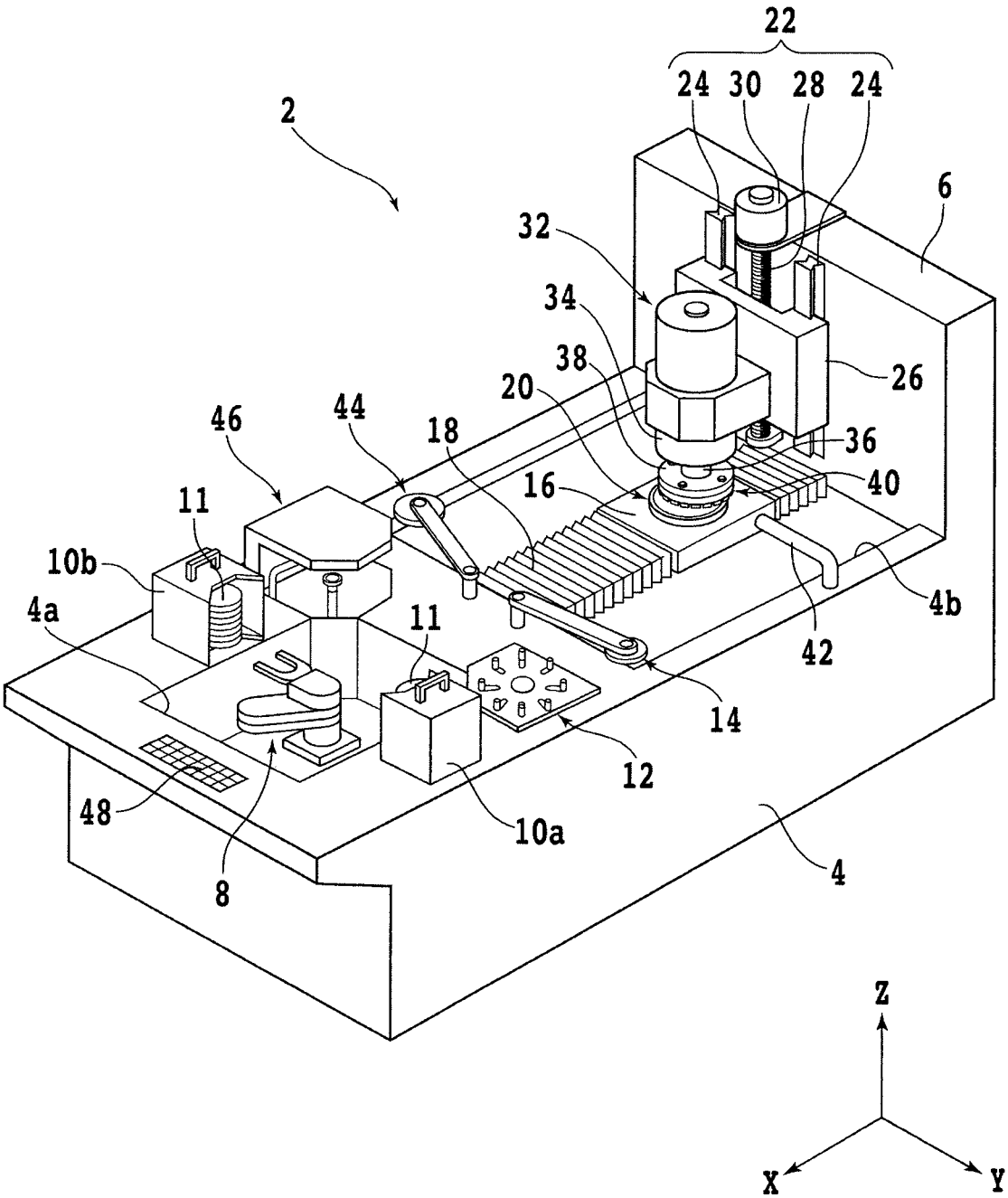
FIG. 1 is a perspective view schematically showing a configuration example of grinding apparatus (processing apparatus) to be used in a processing method according to an embodiment of the present invention.

First, an example of the configuration of a grinding apparatus (processing apparatus) used in the processing method according to this embodiment will be described. FIG. 1 is a perspective view showing a configuration example of the grinding apparatus according to this embodiment. As shown in FIG. 1, a grinding apparatus (processing apparatus) 2 in this embodiment includes a rectangular parallelepiped base 4 on which to mount various components of the apparatus. At a rear end of the base 4, a support wall 6 extending upward is disposed upright. An upper surface of the base 4 is formed with an opening 4*a* on a front side, and a conveying mechanism 8 for conveying a plate-shaped workpiece 11 is provided inside the opening 4*a*. In addition, cassettes 10*a* and 10*b* for housing the workpieces 11 are mounted in regions at lateral sides of the opening 4*a*.

The workpiece 11 is, for example, a disc-shaped WL-CSP substrate, in which metal posts (electrodes) are embedded on the side of a surface 11*a* (see FIG. 2) constituting a work surface (surface to be processed). In this embodiment, besides, a protective member 13 having roughly the same diameter as that of the workpiece 11 is attached to the back side of the workpiece 11 (see FIG. 2). It should be noted, however, that the configuration of the workpiece 11 is not restricted to this. Any plate-shaped body that includes metal in a work surface thereof, such as a metal plate, a TSV wafer provided with TSV (Through Silicon Via), or wafer formed with a metal film, can be suitably processed by the processing method according to this embodiment. In addition, the protective member 13 may not necessarily be attached to the back side of the workpiece 11.

On the rear side of a mount region where to mount the cassette 10*a*, there is provided a positioning mechanism 12 for positioning of the workpiece 11 which is temporarily placed. For instance, the workpiece 11 conveyed from the cassette 10*a* by the conveying mechanism 8 is mounted on the positioning mechanism 12, by which centering of the workpiece 11 is conducted. On the rear side of the positioning mechanism 12 is provided a feeding-in mechanism 14 which holds the workpiece 11 by suction and swivels.

On the rear side of the feeding-in mechanism 14 is formed an opening 4*b*. An X-axis moving table 16, an X-axis moving mechanism (not shown) for moving the X-axis moving table 16 in an X-axis direction (front-rear direction), and a waterproof cover 18 covering the X-axis moving mechanism are disposed inside the opening 4*b*. The X-axis moving mechanism includes a pair of X-axis guide rails (not shown) parallel to the X-axis direction, and the X-axis moving table 16 is slidably disposed on the X-axis guide rails. A nut section (not shown) is fixed to the lower side of the X-axis moving table 16, and the nut section is in screw engagement with an X-axis ball screw (not shown) parallel to the X-axis guide rails. An X-axis pulse motor (not shown) is connected to one end portion of the X-axis ball screw. With the X-axis ball screw rotated by the X-axis pulse motor, the X-axis moving table 16 is moved in the X-axis direction along the X-axis guide rails.

On the X-axis moving table 16 is provided a chuck table 20 by which the workpiece 11 is suction held. The chuck table 20 is connected with a rotational drive source (not shown) such as a motor, and is rotated about an axis of rotation that extends in a Z-axis direction (vertical direction). The chuck table 20 is moved, by the aforementioned X-axis moving mechanism, between a front-side feeding-in/out position where the workpiece 11 is fed in and fed out and a rear-side grinding position where the workpiece 11 is ground. A part of an upper surface of the chuck table 20 constitutes a holding surface on which the workpiece 11 is suction held. The holding surface is connected with a suction source (not shown) by way of a channel (not shown) formed inside the chuck table 20. The workpiece 11 fed in by the feeding-in mechanism 14 is suction held onto the chuck table 20 by a negative pressure of the suction source that acts on the holding surface.

A Z-axis moving mechanism 22 is provided on a front surface of the support wall 6. The Z-axis moving mechanism 22 includes a pair of Z-axis guide rails 24 parallel to the Z-axis direction, and a Z-axis moving table 26 is slidably disposed on the Z-axis guide rails 24. A nut section (not shown) is fixed to the rear side (back side) of the Z-axis moving table 26, and the nut section is in screw engagement with a Z-axis ball screw 28 parallel to the Z-axis guide rails 24. A Z-axis pulse motor 30 is connected to one end portion of the Z-axis ball screw 28. With the Z-axis ball screw 28 rotated by the Z-axis pulse motor 30, the Z-axis moving table 26 is moved in the Z-axis direction along the Z-axis guide rails 24. A Z-axis scale (not shown) for indicating the position (height position) of the Z-axis moving table 26 in the Z-axis direction is additionally provided in a position close to the Z-axis guide table 24. The position of the Z-axis moving table 26 in the Z-axis direction is read by a scale reading mechanism (not shown) provided on the Z-axis moving table 26.

On a front surface of the Z-axis moving table 26 is provided a grinding mechanism (processing means) 32 for grinding the workpiece 11. The grinding mechanism 32 includes a spindle housing 34 fixed to the Z-axis moving table 26. A spindle 36 rotatable about an axis of rotation extending in the Z-axis direction is supported on the spindle housing 34. A disc-shaped wheel mount 38 is fixed to a lower end portion of the spindle 36, and a grinding wheel 40 having roughly the same diameter as that of the wheel mount 38 is mounted on a lower surface of the wheel mount 38. The grinding wheel 40 includes a disc-shaped wheel base 40*a* formed of a metallic material such as stainless steel. A plurality of grindstones 40*b* are fixed to the lower surface of the wheel base 40*a*, along the whole perimeter of the lower surface. An upper end of the spindle 36 is connected with a rotational drive source (not shown) such as a motor, and the grinding wheel 40 is rotated by a rotating force transmitted from the rotational drive source. In addition, the grinding wheel 40 is pressed against the surface 11*a* of the workpiece 11 (which is suction held by the chuck table 20) by the aforementioned Z-axis moving mechanism 22.

In a position adjacent to the grinding mechanism 32, there is provided a nozzle 42 for supplying a processing fluid 50 (see FIG. 2) to the surface 11*a* of the workpiece 11. The nozzle 42 is connected with a processing fluid supply source (not shown). While supplying the processing fluid 50, the grinding wheel 40 (grindstones 40*b*) in rotation is brought into contact with the surface 11*a* of the workpiece 11 that includes metal, whereby the surface 11*a* of the workpiece 11 can be suitably ground (processed). The processing fluid 50 will be detailed later.

In a position adjacent to the feeding-in mechanism 14 in a Y-axis direction (left-right direction), there is provided a feeding-out mechanism 44 which holds the workpiece 11 by suction and swivels. On the front side of the feeding-out mechanism 44 and on the rear side of the mount region where the cassette 10*b* is mounted, there is disposed a cleaning mechanism 46 for cleaning the workpiece 11 after grinding. The workpiece 11 cleaned by the cleaning mechanism 46 is conveyed by the conveying mechanism 8, to be housed in the cassette 10*b*. On the front side of the opening 4*a* is provided a control panel 48 through which to input various grinding conditions such as rotating speeds of the chuck table 20 and the spindle 36, lowering velocity of the grinding wheel 40, amount of the processing fluid 50 supplied, etc.

Now, the processing method conducted by use of the aforementioned grinding apparatus 2 will be described below. First, a holding step of holding the workpiece 11 by the chuck table 20 is conducted. In the holding step, the protective member 13 fixed to the back side of the workpiece 11 is put into contact with the holding surface of the chuck table 20, and the negative pressure of the suction source is applied thereto. As a result, the workpiece 11 is suction held onto the chuck table 20, with the protective member 13 therebetween.

Figure 2:
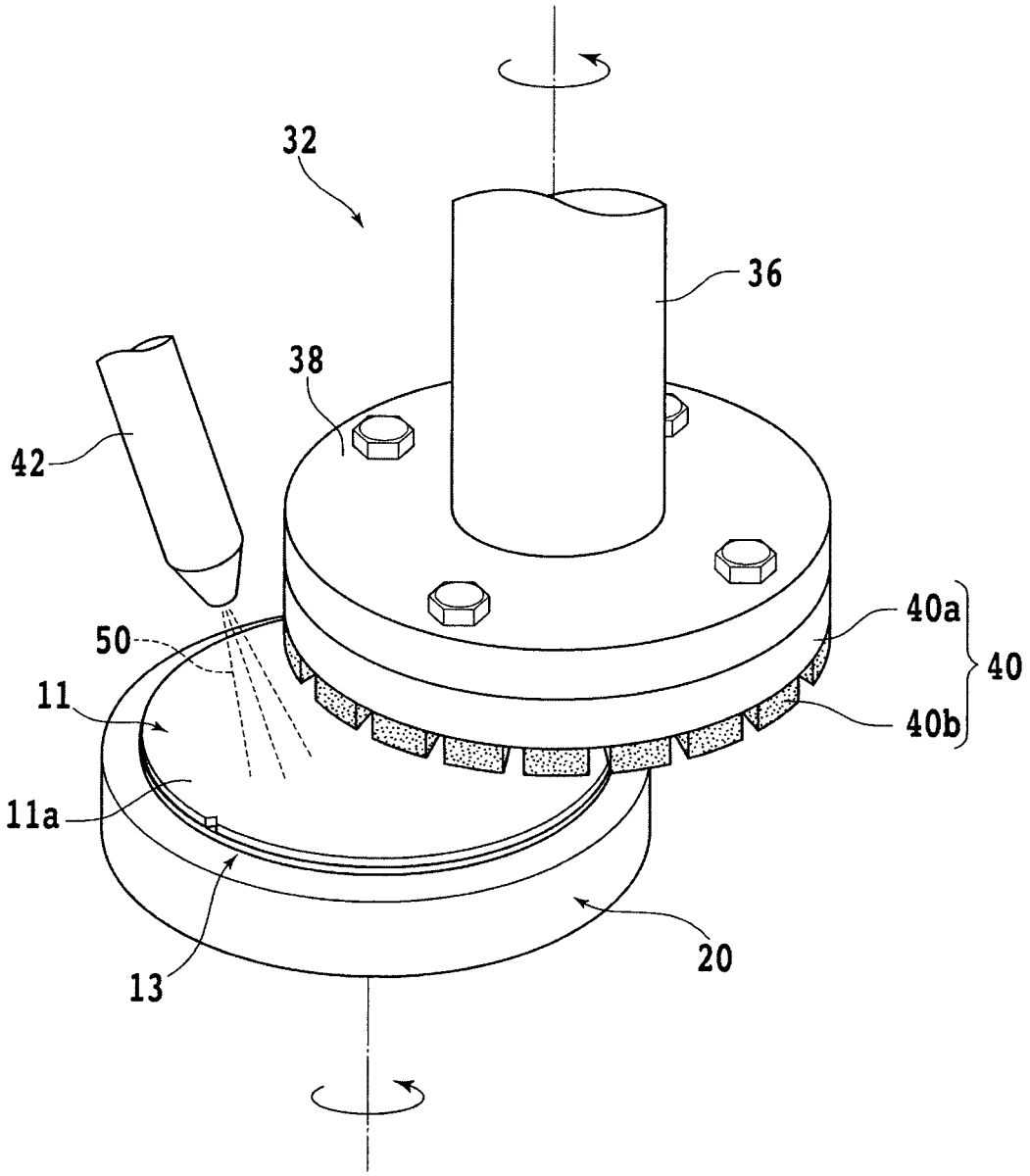
FIG. 2 is a perspective view schematically showing a processing step.

After the holding step, a processing step of processing the workpiece 11 is carried out. FIG. 2 is a perspective view schematically illustrating the processing step. In the processing step, with the chuck table 20 and the spindle 36 being rotated, the grinding wheel 40 is lowered to bring the grindstones 40*b* into contact with the surface 11*a* of the workpiece 11. Concurrently, the processing fluid 50 is supplied from the nozzle 42 to the surface 11*a* of the workpiece 11.

In the processing method in this embodiment, a processing fluid 50 that contains an organic acid and an oxidizing agent is used. By the processing fluid 50, the grinding of the workpiece 11 can be carried out while suppressing ductility of the metal included in the surface 11*a* of the workpiece 11 through modification of the metal. Upon this grinding, burrs (projections) would not be generated from the metal. In addition, since the workpiece 11 that includes metal can be suitably processed by this grinding alone, it is unnecessary to combine this processing method with other method or methods.

As the organic acid, there can be used, for example, a compound that has at least one carboxyl group and at least one amino group in its molecule. In this case, it is preferable that at least one of the amino group(s) is a secondary or tertiary amino group. In addition, the compound used as the organic acid may have a substituent group.

As the organic acid, there can be used amino acids. Examples of the amino acids usable here include glycine, dihydroxyethylglycine, glycylglycine, hydroxyethylglycine, N-methylglycine, β-alanine, L-alanine, L-2-aminobutyric acid, L-norvaline, L-valine, L-leucine, L-norleucine, L-alloisoleucine, L-isoleucine, L-phenylalanine, L-proline, sarcosine, L-ornithine, L-lysine, taurine, L-serine, L-threonine, L-allothreonine, L-homoserine, L-thyroxine, L-tyrosine, 3,5-diiodo-L-tyrosine, β-(3,4-dihydroxyphenyl)-L-alanine, 4-hydroxy-L-proline, L-cysteine, L-methionine, L-ethionine, L-lanthionine, L-cystathionine, L-cystine, L-cystic acid, L-glutamic acid, L-aspartic acid, S-(carboxymethyl)-L-cysteine, 4-aminobutyric acid, L-asparagine, L-glutamine, azaserine, L-canavanine, L-citrulline, L-arginine, δ-hydroxy-L-lysine, creatine, L-kynurenine, L-histidine, 1-methyl-L-histidine, 3-methyl-L-histidine, L-tryptophane, actinomycin C1, ergothioneine, apamin, angiotensin I, angiotensin II, antipain, etc. Among others, particularly preferred are glycine, L-alanine, L-proline, L-histidine, L-lysine, and dihydroxyethylglycine.

Also, amino polyacids can be used as the organic acid. Examples of the amino polyacids usable here include iminodiacetic acid, nitrilotriacetic acid, diethylenetriaminepentaacetic acid, ethylenediaminetetraacetic acid, hydroxyethyliminodiacetic acid, nitrilotrismethylenephosphonic acid, ethylenediamine-N,N,N',N'-tetramethylenephosphonic acid, 1,2-diaminopropanetetraacetic acid, glycol ether diaminetetraacetic acid, transcyclohexanediaminetetraacetic acid, ethylenediamineorthohydroxyphenylacetic acid, ethylenediaminedisuccinic acid (SS isomer), β-alaninediacetic acid, N-(2-carboxylatoethyl)-L-aspartic acid, N,N'-bis(2-hydroxybenzyl)ethylenediamine-N,N'-diacetic acid, etc.

Further, carboxylic acids can be used as the organic acid. Examples of the carboxylic acids usable here include saturated carboxylic acids such as formic acid, glycolic acid, propionic acid, acetic acid, butyric acid, valeric acid, hexanoic acid, oxalic acid, malonic acid, glutaric acid, adipic acid, malic acid, succinic acid, pimelic acid, mercaptoacetic acid, glyoxylic acid, chloroacetic acid, pyruvic acid, acetoacetic acid, glutaric acid, etc., unsaturated carboxylic acids such as acrylic acid, methacrylic acid, crotonic acid, fumaric acid, maleic acid, mesaconic acid, citraconic acid, aconitic acid, etc., and cyclic unsaturated carboxylic acids such as benzoic acids, toluic acid, phthalic acids, naphthoic acid, pyromellitic acid, naphthalic acid, etc.

As the oxidizing agent, there can be used, for example, hydrogen peroxide, peroxides, nitrates, iodates, periodates, hypochlorites, chlorites, chlorates, perchlorates, persulfates, dichromates, permanganate, cerates, vanadates, ozonated water, silver(II) salts, iron(III) salts, and their organic complex salts.

Besides, an anticorrosive may be mixed in the processing fluid 50. Mixing of the anticorrosive makes it possible to prevent corrosion (elution) of the metal included in the workpiece 11. As the anticorrosive, there is preferably used a heterocyclic aromatic ring compound which has at least three nitrogen atoms in its molecule and has a fused ring structure or a heterocyclic aromatic ring compound which has at least four nitrogen atoms in its molecule. Further, the aromatic ring compound preferably includes a carboxyl group, sulfo group, hydroxyl group or alkoxyl group. Specific preferable examples of the aromatic ring compound include tetrazole derivatives, 1,2,3-triazole derivatives, and 1,2,4-triazole derivatives.

Examples of the tetrazole derivatives usable as the anticorrosive include those which do not have a substituent group on the nitrogen atoms forming the tetrazole ring and which have, introduced into the 5-position of the tetrazole, a substituent group selected from the group consisting of sulfo group, amino group, carbamoyl group, carbonamide group, sulfamoyl group, and sulfoneamide group, or an alkyl group substituted with at least one substituent group selected from the group consisting of hydroxyl group, carboxyl group, sulfo group, amino group, carbamoyl group, carbonamide group, sulfamoyl group, and sulfonamide group.

Examples of the 1,2,3-triazole derivatives usable as the anticorrosive include those which do not have a substituent group on the nitrogen atoms forming the 1,2,3-triazole ring and which have, introduced into the 4-position and/or 5-position of the 1,2,3-triazole, a substituent group selected from the group consisting of hydroxyl group, carboxyl group, sulfo group, amino group, carbamoyl group, carbonamide group, sulfamoyl group, and sulfonamide group, or an alkyl or aryl group substituted with at least one substituent group selected from the group consisting of hydroxyl group, carboxyl group, sulfo group, amino group, carbamoyl group, carbonamide group, sulfamoyl group, and sulfoneamide group.

Besides, examples of the 1,2,4-triazole derivatives usable as the anticorrosive include those which do not have a substituent group on the nitrogen atoms forming the 1,2,4-triazole ring and which have, introduced into the 2-position and/or 5-position of 1,2,4-triazole, a substituent group selected from the group consisting of sulfo group, carbamoyl group, carbonamide group, sulfamoyl group, and sulfonamide group, or an alkyl or aryl group substituted with at least one substituent group selected from the group consisting of hydroxyl group, carboxyl group, sulfo group, amino group, carbamoyl group, carbonamide group, sulfamoyl group, and sulfonamide group.

In the processing method according to this embodiment, the rotating speed of the spindle 36 is, for example, 6,000 rpm, and the rotating speed of the chuck table 20 is, for example, 300 rpm. It is to be noted, however, that the rotating speeds of the spindle 36 and the chuck table 20 are not limited to these values, and can be modified as desired.

When the spindle 36 is lowered at a predetermined feed rate under the aforementioned conditions, the surface 11*a* of the workpiece 11 can be ground. This grinding is carried out while measuring the thickness of the workpiece 11 by a thickness measuring sensor of a contact type or a non-contact type. When the workpiece 11 is ground to a predetermined thickness, the processing step ends.

As has been described above, in the processing method according to this embodiment, the workpiece 11 can be ground (or polished) while suppressing the ductility of the metal present at the surface (work surface) 11*a* of the workpiece 11 through modification of the metal by supplying the processing fluid 50 that contains the organic acid and the oxidizing agent. Therefore, the workpiece 11 that includes metal can be suitably processed through a simple process.

It is to be understood that the present invention is not limited to the description of the embodiment above, and the invention can be carried out with various modifications. For instance, the processing fluid 50 is not restricted to the one that is configured as aforementioned. Other amino acids, amino polyacids, carboxylic acids and the like than the aforementioned may also be used as the organic acid. Other azole compounds (tetrazoles, triazoles, benzotriazoles, etc.) than the aforementioned may be used as the anticorrosive.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A method of processing a workpiece by a processing means, wherein the workpiece includes metal posts embedded in a work surface thereof, the processing means including:

a spindle to which a wheel mount is fixed, a grinding wheel including a plurality of grindstones and mounted on a lower surface of the wheel mount, the method comprising:

a processing step of grinding the work surface including the metal posts embedded therein by rotating the grinding wheel of the processing means while suppressing ductility of the metal of the metal posts by supplying a processing fluid to the work surface of the workpiece to modify the metal of the metal posts, wherein the processing fluid contains an organic acid and an oxidizing agent, and wherein said grinding is performed until the thickness of the workpiece is reduced to a predetermined thickness by rotating the spindle and the workpiece and bringing the grindstones into contact with the work surface of the workpiece while lowering the grinding wheel at a predetermined feed rate.

2. The method of processing according to claim 1, wherein the processing fluid further contains an anticorrosive.

3. The method of processing according to claim 1, wherein the workpiece is a disc-shaped WL-CSP substrate.

4. The method of processing according to claim 1, wherein said grinding is performed by rotating the spindle and the workpiece so as to move the grindstones from the outside to the inside of the work surface.

5. The method of processing according to claim 1, wherein the rotating speed of the spindle is twenty times greater than the rotating speed of the workpiece.

6. The method of processing according to claim 1, wherein the rotating speed of the spindle is 6,000 rpm and the rotating speed of the workpiece is 300 rpm.

7. The method of processing according to claim 1, wherein the rotating speed of the spindle is at least ten times greater than the rotating speed of the workpiece.

8. The method of processing according to claim 1, wherein the organic acid comprises a compound that includes at least one carboxyl group and at least one amino group in its molecule.

9. The method of processing according to claim 8, wherein the at least one amino group comprises a secondary amino group.

10. The method of processing according to claim 8, wherein the at least one amino group comprises a tertiary amino group.

11. The method of processing according to claim 1, wherein the organic acid includes at least one of the following: L-alanine, L-proline, L-histidine, L-lysine, and dihydroxyethylglycine.

12. The method of processing according to claim 1, wherein the organic acid is an amino polyacid.

13. The method of processing according to claim 1, wherein the organic acid includes at least one of the following: iminodiacetic acid, nitrilotriacetic acid, diethylenetriaminepentaacetic acid, ethylenediaminetetraacetic acid, hydroxyethyliminodiacetic acid, nitrilotrismethylenephosphonic acid, ethylenediamine-N,N,N',N'-tetramethylenephosphonic acid, 1,2-diaminopropanetetraacetic acid, glycol ether diaminetetraacetic acid, transcyclohexanediaminetetraacetic acid, ethylenediamineorthohydroxyphenylacetic acid, ethylenediaminedisuccinic acid (SS isomer), β-alaninediacetic acid, N-(2-carboxylatoethyl)-L-aspartic acid, and N,N'-bis(2-hydroxybenzyl)ethylenediamine-N,N'-diacetic acid.

14. The method of processing according to claim 1, wherein the organic acid includes at least one of the following: butyric acid, valeric acid, hexanoic acid, glutaric acid, adipic acid, succinic acid, pimelic acid, mercaptoacetic acid, glyoxylic acid, chloroacetic acid, pyruvic acid, acetoacetic acid, and glutaric acid.

15. The method of processing according to claim 1, wherein the organic acid includes at least one of the following: mesaconic acid and aconitic acid.

16. The method of processing according to claim 1, wherein the organic acid includes at least one of the following: toluic acid and pyromellitic acid.

17. The method of processing according to claim 1, wherein the oxidizing agent includes at least one of the following: an iodate, a periodate, a hypochlorite, a chlorite, a chlorate, a perchlorates, a dichromate, permanganate, a cerate, a vanadate, a silver(II) salt, an iron(III) salt, and their organic complex salts.

* * * * *